US006499421B1

(12) United States Patent
Honigsbaum

(10) Patent No.: US 6,499,421 B1
(45) Date of Patent: Dec. 31, 2002

(54) TACTIOVISUAL DISTANCE-TO-EXIT EXIT-FINDING SYSTEM

(76) Inventor: Richard F. Honigsbaum, 245 Passaic Ave., Apt. A-21, Passaic, NJ (US) 07055

( * ) Notice: Subject to any disclaimer, the term of this patent is extended or adjusted under 35 U.S.C. 154(b) by 0 days.

(21) Appl. No.: 09/547,605

(22) Filed: Apr. 12, 2000

Related U.S. Application Data

(60) Provisional application No. 60/134,937, filed on May 19, 1999, and provisional application No. 60/187,094, filed on Mar. 6, 2000.

(51) Int. Cl.[7] ..... G09F 7/00

(52) U.S. Cl. ..... 116/205; 52/33; 116/DIG. 17

(58) Field of Search ..... 116/200, 205, 116/209, DIG. 17; 52/33, 38, 174, 175, 176, 177; 404/6, 9; 40/542, 570, 596

(56) References Cited

U.S. PATENT DOCUMENTS

| | | | | | |
|---|---|---|---|---|---|
| 1,243,164 | A | * | 10/1917 | Hardesty | 40/615 |
| 1,525,107 | A | * | 2/1925 | Spencer | 205/120 |
| 1,728,731 | A | * | 9/1929 | Hayes | 40/542 |
| 2,076,907 | A | * | 4/1937 | Meigs | 40/596 |
| 2,193,507 | A | * | 3/1940 | Carver | 40/596 |
| 3,940,865 | A | * | 3/1976 | Mori | 40/542 |
| 4,029,994 | A | | 6/1977 | Iwans | |
| 4,347,499 | A | | 8/1982 | Burkman, Sr. et al. | 340/815.69 |
| 4,385,586 | A | | 5/1983 | Schriever | 116/205 |
| 4,401,050 | A | | 8/1983 | Britt et al. | 116/205 |
| 4,679,342 | A | * | 7/1987 | Wilson | 40/616 |
| 4,737,764 | A | | 4/1988 | Harrison | 362/153 |
| 4,754,266 | A | | 6/1988 | Shand et al. | |
| 4,794,373 | A | | 12/1988 | Harrison | 340/286 |
| 4,801,928 | A | * | 1/1989 | Minter | 340/691.2 |

(List continued on next page.)

FOREIGN PATENT DOCUMENTS

| | | | | |
|---|---|---|---|---|
| CA | 874 544 | | 6/1971 | |
| GB | 2207538 | * | 2/1989 | 40/570 |
| GB | 2 214 681 | | 9/1989 | |
| GB | 2 224 154 | | 4/1990 | |

OTHER PUBLICATIONS

"Hotel/Motel Fire Safety", ©1999 National Fire Protection Association.

James E. Goodwin "Worldwide Timetable", Oct. 31, 1998–Jan. 4, 2000.

"Detectable Warnings", ADA Handbook, Oct. 1991 pp. 53–54.

"Means of Egress", BOCA 1996, p. 129.

"Means of Egress," NFPA 1, 1997 Edition, p. 1–27–1–28 & 153.

"Means of Escape", Regulation 28, SOLAS 1997 pp. 206–210.

"Subpart 112.15—Emergency Loaods", Coast Guard, DOT, 46 CFR §112.15 (Oct. 1, 1999 Edition), pp. 252–253.

"Emergency Exit Marking", Administration DOT, 14 CFR §25.811 (Jan. 1, 1999 Edition) pp. 404–407.

14 CFR 25.775–777, Federal Aviation Adminstration, DOT, pp 340–342, last amd't 1978.

*Primary Examiner*—Christopher W. Fulton
*Assistant Examiner*—R. Alexander Smith
(74) *Attorney, Agent, or Firm*—Cohen, Pontani, Lieberman & Pavane

(57) ABSTRACT

This invention uses a family of exit-finding aids to enable occupants of rooms or workspaces in buildings, cabins in ships, seats in aircraft cabins, auditoriums, theaters, etc. to know the distance and direction to the nearest exit in each direction by touch as well as by sight; to know so before leaving those spaces; to similarly know the escape paths to each of those exits; to similarly know the distance and direction to alternate exits along the escape path; to similarly confirm arrival at an exit; and to similarly know the distance and direction to alternates to exits that are unusable.

58 Claims, 7 Drawing Sheets

U.S. PATENT DOCUMENTS

D305,779 S * 1/1990 Schriever ..... D20/40
5,027,741 A 7/1991 Smith et al.
5,065,837 A * 11/1991 Szudy ..... 182/18
5,246,757 A * 9/1993 Condon et al. ..... 428/40.9
5,331,918 A 7/1994 Honigsbaum ..... 116/205
5,438,781 A * 8/1995 Landmann ..... 40/584
5,512,122 A * 4/1996 Sokyrka ..... 156/275.5
5,636,479 A * 6/1997 Haraldsen et al. ..... 52/33
5,714,255 A * 2/1998 Yeh ..... 428/364
5,724,909 A * 3/1998 Pitman et al. ..... 116/202
5,775,016 A * 7/1998 Chien ..... 40/544
5,810,597 A * 9/1998 Allen, Jr. et al. ..... 434/112
5,836,835 A * 11/1998 Grimsley ..... 473/414
5,961,072 A * 10/1999 Bodle ..... 244/118.5
6,025,773 A * 2/2000 Bresnan ..... 340/407.1
6,073,575 A * 6/2000 Wotherspoon ..... 116/205
6,237,266 B1 * 5/2001 Tassey et al. ..... 40/542

* cited by examiner

FIG. 1
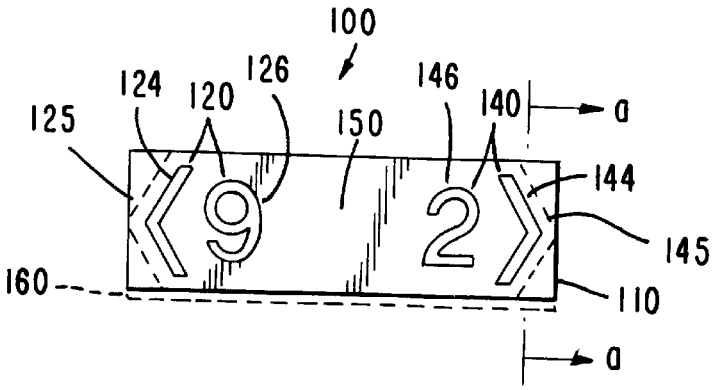
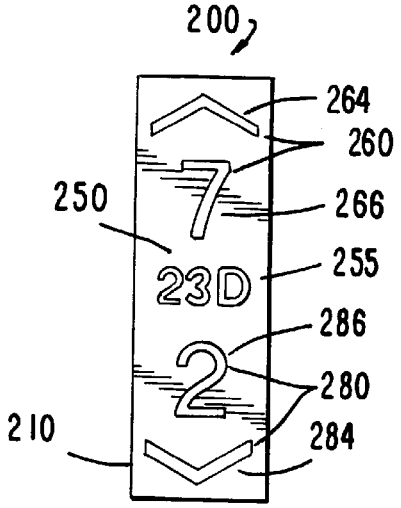
FIG. 2
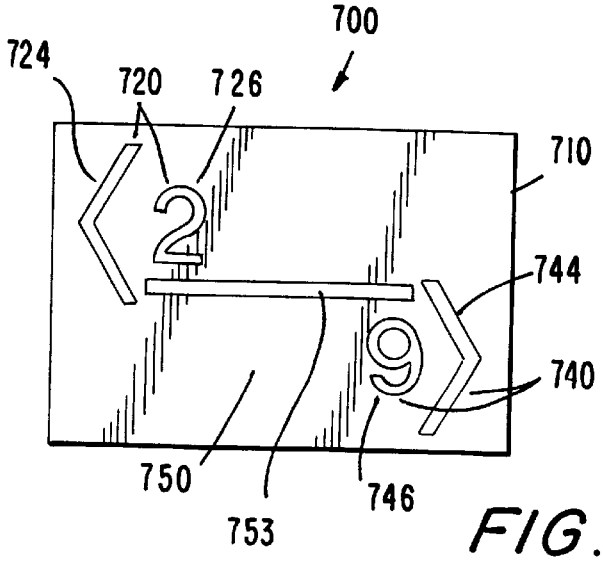
FIG. 7

TACTIOVISUAL DISTANCE-TO-EXIT EXIT-FINDING SYSTEM

RELATED APPLICATIONS

This application claims priority from U.S. Provisional Patent Application Serial No. 60/134,937 which was filed on May 19, 1999 and U.S. Provisional Patent Application Serial No. 60/187,094 which was filed on Mar. 6, 2000.

BACKGROUND OF THE INVENTION

1. Field of the Invention

This invention relates to finding exits in a structure by touch as well as by sight, and more particularly to finding the nearest exit.

2. Description of the Related Art

The most common exit-finding aids are the ubiquitous illuminated overhead EXIT signs that satisfy §1023.0 of The Building Officials and Code Administrators International, Inc. National Building Code (BOCA), §4–7 of the National Fire Protection Association, Inc. Fire Prevention Code (NFPA 1), 14 CFR 25.812(b), 46 CFR 112.15-1(d), etc., and the simplified vision-dependent floor plans posted on or near the doors of hotel, motel and dormitory rooms, passenger ship cabins, etc. to satisfy NFPA 1 §16-2.4.1 and SOLAS II-2/28-1/1.7. While overhead EXIT signs are effective in clear air, they are hardly so when vision is compromised or when they are obscured by smoke, and the simplified floor plans are of doubtful effectiveness not only because they are vision-dependent aids that can also be obscured by smoke, but also because they are not readily interpreted by people unfamiliar with them.

Birch, U.K. Patent Application GB 2 214 681 A; Burkman et al, U.S. Pat. No. 4,347,499; Harrison, U.S. Pat. Nos. 4,737,764 & 4,794,373; Iwans, U.S. Pat. No. 4,029,994; and Shand, U.S. Pat. No. 4,754,266 attempt to address smoke obscuration of overhead signs with fixed or sequentially illuminated exit-finding aids at eye, hand or floor level, where they are less likely to be obscured by smoke, but are, unfortunately, more likely to suffer accidental or intentional damage. Further, these lower level aids are also both electrically powered and vision-dependent, and like the overhead signs, are ineffective when power supplies fail or vision is compromised. So too is the low-location lighting mandated by 14 CFR 25.812(e) and by II-2, Regulation 28/1.10 of the International Maritime Organization publication SOLAS.

Britt et al, U.S. Pat. No. 4,401,050; Davis, Canadian Patent 874554; Honigsbaum, U.S. Pat. No. 5,331,918; Keen et al, U.K. Patent Application GB 2 224154 A; Shriever, U.S. Pat. No. 4,385,586; and Smith et al, U.S. Pat. No. 5,027,741 teach exit-finding aids having tactile features that make them effective under all conditions of vision and visibility.

Britt, Davis, and Keen teach guide strips that tactilely indicate direction to an exit, and Keen's strips have overprinted arrows that serve visually, while Britt's strips also include a phosphorescent material intended to make them visually effective when lights fail. Davis' strips, however, have no visual features other than those inherent in their tactile arrangement because they are intended to serve when vision does not.

Honigsbaum teaches a system comprising a repetitive array of touch-and-sight-recognizable directional elements on the seats, tray tables and floors of aircraft passenger cabins to indicate direction to the nearest exit both tactilely and visually, and is the only one of the tactile arrangements mentioned that has alternative touch-and-sight-recognizable marking on main aisle floors that can satisfy 14 CFR 25.812(e)(1), i.e., to "—visually identify the emergency escape path along the cabin aisle floor to the first exits or pair of exits forward and aft—." While both the alternative Honigsbaum arrangement and 14 CFR 25.812(e)(1) address the matter of direction to usable alternatives to unusable exits, neither addresses the plight of a passenger who leaves seat 41D in a Boeing 767-300 and struggles to reach an exit twenty seat rows forward because the aids of 14 CFR 25.812(e)(1) do not tell him the location of the nearest exit, i.e., the exit one seat-row aft.

Smith teaches a directional carpeting having fibers inclined to tactilely indicate direction to an exit and luminous arrow overlays to do so visually.

Shriever teaches arrowhead-shaped wall attachments that not only indicate direction to the nearest exit by touch as well as by sight, but also so indicate the number of doors to that exit by the number of such attachments arranged vertically on the "toward exit" side of a door, and by the number of bumps or dimples on each attachment. While Shriever's "number of doors" feature can be effective where only a few doors are involved, it merely adds to the confusion it is intended to eliminate when that number is large. Worse, Schriever's teachings not only ignore the possibility that an exit may be unusable by failing to indicate distance and direction to alternative ones; they redirect persons searching for usable alternatives right back to the unusable one!

Although tactile exit-finding aids and the exit-finding systems that use them are effective when systems based upon vision-dependent aids alone are not, those taught by the related art have not been adopted, not only for the reasons mentioned, but also because, excepting the related-art teachings of Honigsbaum extended to buildings and ships, they can only be accessed by abandoning what may be the greater safety of a room or cabin for the more hostile environment of a corridor.

The exit-finding system of the present invention addresses the aforementioned shortcomings of that art.

SUMMARY OF THE INVENTION

According to this invention, I have for the first time developed an exit-finding system that uses a family of tactiovisual exit-finding aids to enable occupants of fixed defined occupiable spaces such as rooms or workspaces in buildings, cabins in ships, seats in aircraft cabins, auditoriums, theaters, etc. to know the distance and direction to the nearest exit in each direction by touch as well as by sight; to know so before leaving those spaces; to similarly know the escape paths to each of those exits; to similarly know the distance and direction to alternate exits along the escape path; to similarly confirm arrival at an exit; and to similarly know the distance and direction to alternates to exits that are unusable.

According to this invention, these aids tactiovisually display distance and direction to each nearest exit as symbol-character pair comprising a directional symbol and a number: the symbol indicating direction to an exit by touch as well as by sight; the number similarly indicating distance to that exit in terms of fixed touch-and-sight-recognizable architectural features such as doors along a corridor, seat rows in an aircraft passenger cabin, etc.

According to first preferred aid embodiments of this invention, tactiovisual exit-finding aids for fixed defined spaces such as ship cabins, hotel, motel and dormitory rooms, offices, etc. accessed via corridors and having exits to the left and to the right of a space, the aids are on at least the space side of the doors separating those spaces from those corridors and are horizontally oriented rectangles displaying two horizontally oriented symbol-number pairs, each pair offset from the center of the aid in the direction of the corresponding exit: the pair offset to the left indicating distance and direction to the nearest exit to the left of the aid; the pair offset to the right indicating distance and direction to the nearest exit to the right of that aid.

According to second preferred aid embodiments of this invention, tactiovisual exitfinding aids for spaces such as fixed seats arranged in rows in aircraft passenger cabins, auditoriums, theaters, etc. having exits forward and aft, the aids are on seat parts such as armrests, backs, sitting surfaces, tray tables, etc., and are vertically oriented rectangles displaying two vertically oriented symbol-number pairs, each pair offset from the center of the aid in the direction of the corresponding exit: the pair offset to the upper part of the aid indicating distance and direction to the nearest exit forward of the aid; the pair offset to the lower part of the aid indicating distance and direction to the nearest exit aft of the aid.

According to third preferred aid embodiments of this invention, tactiovisual aids for identifying exits, stairways to exits, etc., the aids are on at least the corridor side of access doors and access openings to those exits, stairways, etc., and are squares the diagonals of which are horizontal and vertical respectively, the squares displaying horizontally oriented symbol-number pairs offset to the horizontal comers of the aid to indicate distance and direction to the nearest alternate exits to the left and to the right of the aid, and vertically oriented symbol-number pairs offset to the vertical comers of the aid to indicate the number of floors up or down to the nearest exit or alternate exit.

According to a fourth preferred aid embodiment of this invention, tactiovisual escape path marking, the aids are floor based arrays of directional symbols that indicate direction to an exit.

The exit-finding aids of this invention are not intended as alternatives to familiar vision-dependent aids such as illuminated EXIT signs; they are intended to complement them by serving effectively under all conditions of vision and visibility; i.e., when vision-dependent aids cannot.

The various features of novelty which characterize the invention are pointed out with particularity in the claims annexed to and forming a part of the disclosure. For a better understanding of the invention, its operating advantages, and specific objectives attained by its use, reference should be had to the drawings and descriptive matter in which there are illustrated and described preferred embodiments of the invention.

BRIEF DESCRIPTION OF THE DRAWINGS

In the drawings:

FIG. 1 is an elevational view of a door-based exit-finding aid in accordance with the present invention;

FIG. 2 is an elevational view of a tray-table-based exit-finding aid in accordance with the present invention;

FIG. 7 is an elevational view of an alternate door-based exit-finding aid in accordance with the present invention;

DETAILED DESCRIPTION OF THE PRESENTLY PREFERRED EMBODIMENTS

Figure 3:
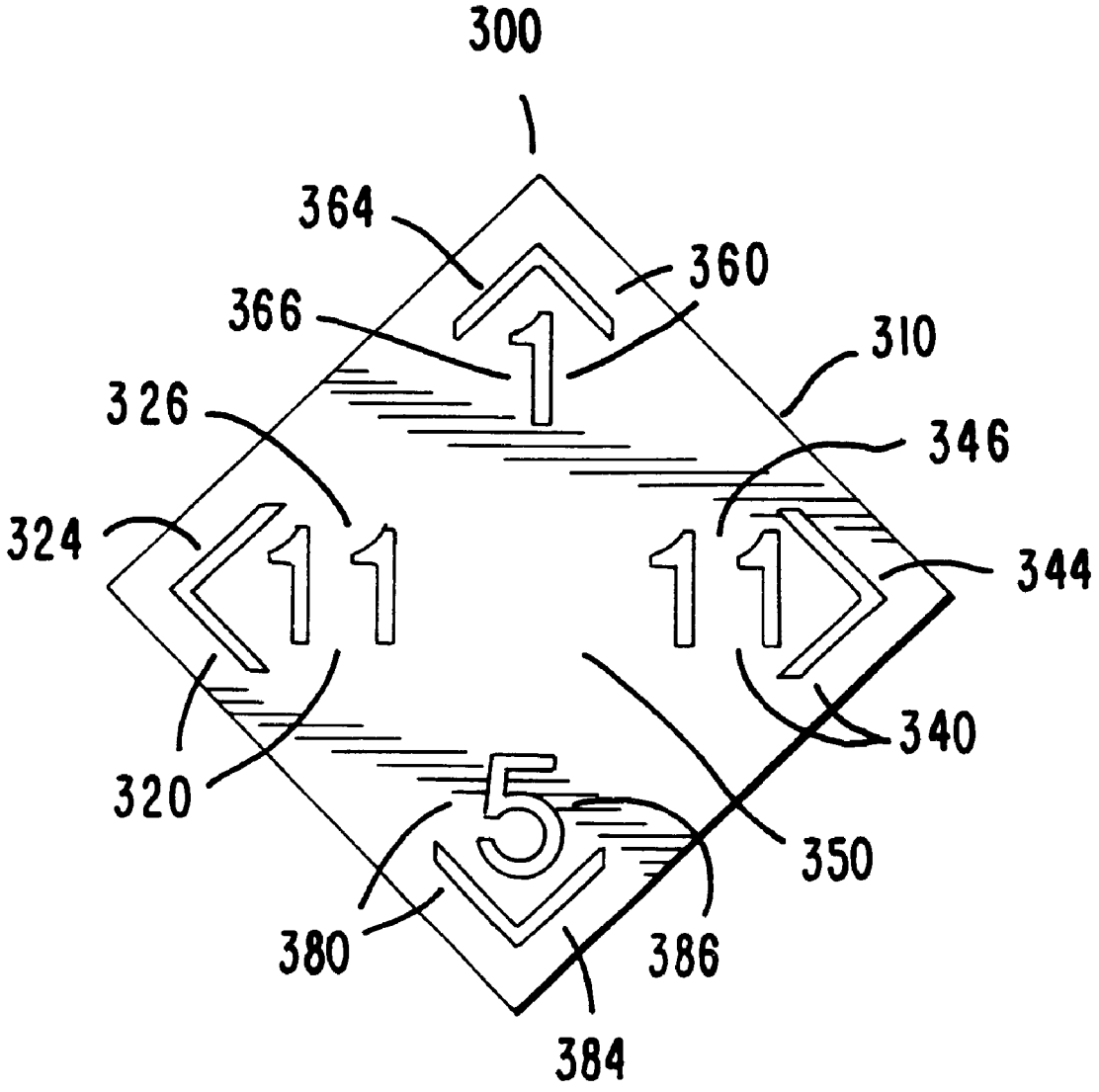
FIG. 3 is an elevational view of an exit-door-based exit-finding aid in accordance with the present invention.

Turning now to the drawings, the embodiment of FIG. 1 is an aid for facilitating exit-finding in accordance with the present invention. It does so by indicating distance and direction to the nearest exits in structures having escape paths to exits to the left and to the right of the aid, and is generally designated 100 in the drawing Aids 100 are intended for structures such as dormitories, hotels, motels, office buildings, ships, etc., and are, for the purpose, preferably affixed to or a part of the doors, or alternately the door openings, the door frames, or the parts of the walls or the bulkheads near those doors in those structures. Aids 100 are also applicable to structures such as aircraft passenger cabins, auditoriums, houses of worship, theaters, etc. having exits to the left and to the right of the aid.

Aids 100 are preferably touch-and-sight-recognizable rectangles with their long sides oriented horizontally as shown in the drawing, or alternately the flattened hexagons formed by cutting away the parts of the rectangles to the left of dotted line 125 and to the right of dotted line 145. Aids 100 facilitate exit finding by displaying, preferably tactiovisually, and as illustrated, one symbol-character pair 120, 140 for each direction to an exit, the left pair 120 preferably comprising, in the sequence from left to right, directional symbol 124 indicating direction to the left, and number character 126, proximal to symbol 124, indicating distance to the nearest exit to the left in terms of the count of fixed touch-and-sight-recognizable architectural features such seat rows, doors, doorways, doorway-like openings, etc.; the right pair 140, preferably separated from the left pair 120 by a space 150 that is great enough to facilitate identification of each pair as such by touch as well as by sight, the pair 140 preferably comprising, in the sequence from left to right, number character 146 indicating distance similarly, but to the nearest exit to the right, and directional symbol 144, proximal to number character 146, indicating direction to the right.

Space 150 can alternately be enlarged to accommodate legends such as EXIT, DOORS TO EXIT, SEAT ROWS TO EXIT, etc., but the blank space shown is preferred, not only because legends are language-specific while symbols and number characters are not, but also because language-specific legends can lead persons unfamiliar with the legend language to the erroneous assumption that the aids are of no use to them.

The directional symbols preferred for the aid embodiments of FIG. 1 and for the other aid embodiments of this invention as well are those shown in the drawing and variously described or referred to in the literature as vees, chevrons arrowheads, etc. Symbols so configured are preferred, not only because they are familiar from highway signs and the overhead EXIT signs previously mentioned, but also because they are easier to recognize tactilely than are arrows having both heads and shafts, those having not only heads and shafts but also tails, or the previously ubiquitous closed hand with index finger extended. The directional symbols of choice for the FIG. 1 embodiments are also the directional symbols of choice for the other aid embodiments of this invention.

The number characters preferred for the aid embodiments of this invention are the number characters in use in the country for which the aids are intended, e.g., Arabic numbers in most of the countries that use the Roman alphabet, and the word "character" in the term "symbol-character pair" indicates the number of the previously mentioned architectural features, and can, of course, be a more than one digit number.

The embodiment of FIG. 2 is also an aid for facilitating exit-finding in accordance with the present invention. It does so by indicating distance and direction to the nearest exits in structures having escape paths to exits forward and aft of (or behind) the aid, and is generally designated 200 in the drawing.

Aids 200 are intended for structures such as aircraft passenger cabins, auditoriums, stadiums, theaters, etc. having fixed seats arranged in rows and where exit-finding is facilitated by counting seat rows to exits, and are, for the purpose, preferably affixed to or a part of appropriate parts of those seats, e.g., armrests, backs, tray tables, sitting surfaces, etc. Aids 200 can alternately be affixed to or a part of the means for accessing stairways, or to the walls or bulkheads near them, to indicate the number of floors up or down to grade level exits, overhead bridges or walkways to other buildings, the number of decks to staging areas on ships, etc., but aids in accordance with FIG. 3 are presently preferred for the purpose.

Aids 200 are also preferably touch-and-sight-recognizable rectangles, but with their long sides oriented vertically as shown, or are alternately similarly oriented flattened hexagons formed by the cutting mentioned with respect to FIG. 1.

Aids 200 facilitate exit finding by displaying, preferably tactiovisually, and as illustrated in the drawing, one symbol-character pair 260, 280 for each direction to an exit, the upper pair 260 preferably comprising, in the sequence from top to bottom, directional symbol 264 indicating direction forward, and number character 266, proximal to symbol 264, indicating distance to the nearest exit forward in terms of the count of fixed touch-and-sight-recognizable architectural features such as seat rows; the lower pair 280, preferably separated a touch-and-sight-recognizable distance 250 from the upper pair, preferably comprising, in the sequence from top to bottom, number character 286 similarly indicating distance, but to the nearest exit aft (behind), and directional symbol 284, proximal to number character 286, and indicating direction aft (behind). Separation 250 is also a convenient place for an indicia such as seat identifier 255 shown, or alternately or additionally the previously mentioned legends (the same comments apply).

The embodiment of FIG. 3 is an aid that not only identifies exits but also facilitates the finding of alternate exits in accordance with the present invention, and its distinctive shape, different from that of the other aids, accommodates both.

The aids of FIG. 3, generally designated by the number 300 in the drawing, are preferably touch-and-sight-recognizable squares with their diagonals oriented horizontally and vertically as shown, or are alternately circles or are cruciform combinations of the aids of FIGS. 1 and 2. Aids 300 facilitate exit-finding and identification by displaying, preferably tactiovisually, and as illustrated by FIG. 3, one symbol-character pair 320, 340 for each horizontal direction to an alternate exit, the left pair 320 preferably comprising, in the sequence from left to right, directional symbol 324 indicating direction to the left, and number character 326, proximal to symbol 324, indicating distance to the nearest alternative exit to the left in terms of the count of fixed touch-and-sight-recognizable architectural features such as doors, doorways, doorway-like openings, etc.; the right pair 340, preferably separated a touch-and-sight-recognizable distance 350 from the left pair, and preferably comprising, in the sequence from left to right, number character 346 indicating distance similarly, but to the nearest alternative exit to the right, and directional symbol 344, proximal to number 346, indicating direction to the right.

Aids 300 also preferably display, and also preferably tactiovisually, one symbolcharacter pair 360, 380 for each vertical direction in which there is an exit or alternate exit, the upper pair 360 preferably comprising, in the sequence from top to bottom, symbol 364 indicating direction upward, and number character 366, proximal to symbol 364, indicating vertical distance upward in terms of the count of fixed touch-and-sight-recognizable architectural features such as stair flights, floors or decks from, e.g., a subbasement to grade, a given floor to an overhead bridge or walkway to another building, a lower deck to the staging area on a ship, etc.; the lower pair 380, preferably separated a touch-and-sight-recognizable distance 350 from the upper pair, preferably comprising, in the sequence from top to bottom, number character 386 similarly indicating distance, but downward, and directional symbol 384, proximal to number character 386, and indicating direction downward. Separation 350 is also a convenient place for a floor or deck marker, or alternately or additionally, the previously mentioned legends (the same comments again apply). If aids 300 mark exits on floors or decks that have no exits above, pair 360 would, of course be omitted, if none below, pair 380, and if none above or below, both pairs.

Aids 300 can also facilitate exit row identification and the finding of nearest and alternate exits from exit row seats in structures such as aircraft cabins, auditoriums, theaters, etc., the symbol-character pairs at the left and at the right hand corners indicating direction port (left) and starboard (right) and the number of seats to exits in each corresponding direction respectively; the symbol-character pairs at the top and at the bottom comers indicating direction forward and aft (behind) and the number of seat rows to exits or exit rows in the corresponding direction respectively.

Symbols 124, 144, 264, 284, 324, 344, 364, 384, number characters 126, 146, 266, 286, 326, 346, 366, 386, and pairs 120, 140, 260, 280, 320, 340, 360, 380 of aids 100, 200, 300 are preferably tactiovisual, i.e., each symbol, number character and pair is recognizable by touch if seen and by sight if touched, because the aids of this invention are intended to facilitate exit-finding under all conditions of vision and visibility, and the transition from visual to tactile use is easier when each symbol and character is tactiovisual.

Aids 100, 200, 300 are intended to facilitate exit-finding under the conditions mentioned, and are preferably in accordance with the signage requirements of the Americans with Disabilities Act of 1990 and any revisions thereof, i.e., presently ADA Handbook Appendix B §4.30, because ADA signage is intended to be effective under all conditions of vision, and therefore effective under all conditions of visibility as well. Thus symbols 124, 144, 264, 284, 324, 344, 364, 384 and number characters 126, 146, 266, 286, 326, 346, 366, 386 are presently preferably at least ⅝ in. (16 mm) but no more than 2 in. (50 mm) high, have a width-to-height ratio between 3:5 and 1:1, have a stroke-width-to-height ratio between 1:5 and 1:10, are raised 1/32 in. (0.8 mm) above their background, are light symbols and numbers that contrast with a dark background or vice versa, and have an eggshell, matte or other non-glare finish as does their background. While the non-glare requirement precludes specular symbols and numbers, it does not preclude symbols and numbers that fluoresce, phosphoresce or photoluminesce.

Appendix B §4.30 also mentions Braille, hence the optional Braille block 160 shown dotted in FIG. 1, and by implication, similar blocks for the other embodiments (not shown in the respective drawings).

The aid embodiments of FIGS. 1, 2, 3 and 7 indicate direction to exits by virtue of (1) the orientation their symbols, (2) the position of the symbol of a symbol-character pair with respect to the number character of that pair, (3) the position of a symbol-character pair with respect to the other symbol-character pair or pairs of the aid, (4) the position of the symbol-character pairs of the aid with respect to the center of the aid, and (5) by the shape and orientation of their bases. While (5) is most obvious with respect to FIG. 3-type aids, the aid embodiments of FIGS. 1 and 2 can be made more so by configuring their bases as suggested by the dotted lines 125, 145 of FIG. 1, but at the risk of confusing them with FIG. 3-type aids.

Figure 4A:
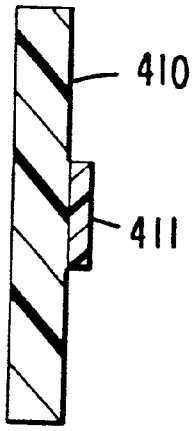
FIG. 4A is a sectional view of a laminated version of an exit-finding aid in accordance with the present invention.

Aids 100, 200, 300 can be made touch-and-sight-recognizable by any of the processes by which decals, labels, nameplates, signs, etc. with raised letters and contrasting backgrounds are made, and sectional views of aids so made are shown in FIGS. 4A, B, C & D. These drawings are those of sections aa of preferred embodiments of FIG. 1, but are also typical of corresponding sections of preferred embodiments of FIGS. 2, 3 & 7.

FIG. 4A is a sectional view of laminated versions of aids in accordance with the present invention. These laminated versions have base layers 410 that are the rectangular bases 110 of FIG. 1 embodiments that support the contrastingly colored face layers 411 that are the symbols 144, but would also be the symbols 124, and the number characters 126, 146 if sectional views of other parts of the aids were shown. The raised symbols and numbers are formed by reverse-engraving two-layer stock, or are previously formed symbols and numbers that are fixedly secured to base layer 410, say with a permanent adhesive. These previously formed symbols and numbers can alternately, of course, be fixedly secured directly to, say, a tray table or a door.

Figure 4B:
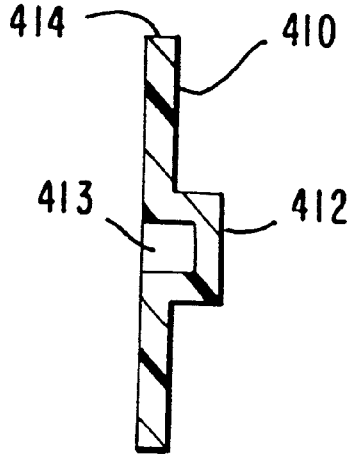
FIG. 4B is a sectional view of a die-stamped version of an exit-finding aid in accordance with the present invention.

FIG. 4B is a sectional view of aids die-formed in accordance with the present invention, the raised symbol 412 and the other symbols and number characters of which are the result of die-stamping, embossing, or otherwise deforming sheet or foil stock 414. The base portions 410 of FIG. 4B are undeformed stock. The required color contrast between the raised portions and the bases of these and other one-piece embodiments is introduced by selective anodizing, oxidizing, printing, painting, enameling, photographic processing, the deforming process, etc. Where the raised portions of FIG. 4B-section aids are at risk of being flattened, that risk can be minimized by introducing backers or fillers into space 413.

Figure 4C:
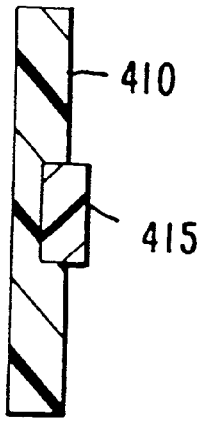
FIG. 4C is a sectional view of a cast version of an exit-finding aid in accordance with the present invention.

FIG. 4C is a sectional view of cast or molded versions of aids in accordance with the present invention intended for applications where cast or molded aids are appropriate, but where the durability of surface treatments that provide the required color contrast is questionable. In the FIG. 4C arrangement suitably colored symbols 415 (shown) and number characters (not shown) are inserted into molds before the color contrasting material corresponding to base portion 410 is injected or poured. Where the durability of surface treatment is adequate, the aids can, of course, be cast or molded conventionally, i.e., the symbols and numbers formed by recesses in the molds, and if so, the section would resemble that of FIG. 4D, and the color contrast would be introduced similarly.

Figure 4D:
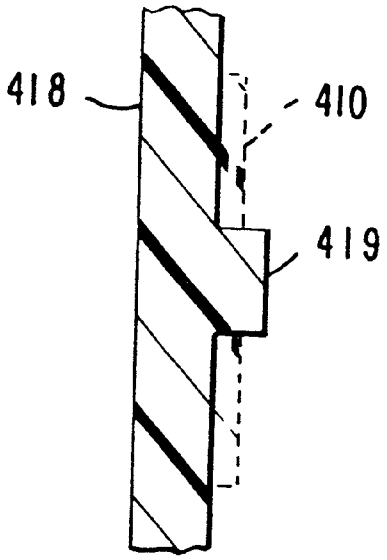
FIG. 4D is a sectional view of an integrally molded version of an exit-finding aid in accordance with the present invention.

FIG. 4D is a sectional view of the fragment 418 of a panel that is part of a door, a wall, a seat, etc., and into which an aid in accordance with the present invention has been low-bas-relief carved, embossed. sculptured, cast, molded, etc. to form symbol 419, the other symbol or symbols, the number characters, and the optional base portion 410 as integral parts that panel. The required color contrast is here too introduced by any of the processes previously mentioned and appropriate, including the insert arrangement of FIG. 4C.

Figure 8C:
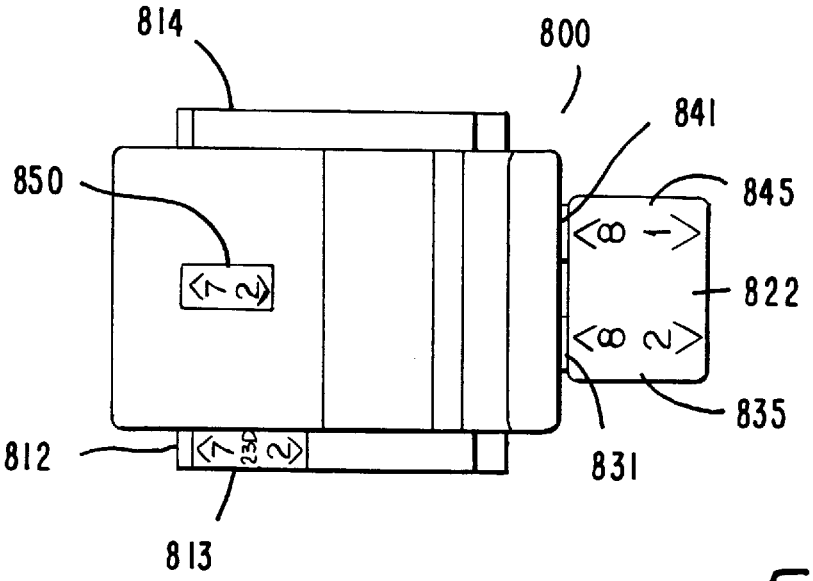
FIG. 8C is a plan view of the non-exit-row aircraft cabin aisle seat of FIG. 8A.
Figure 8B:
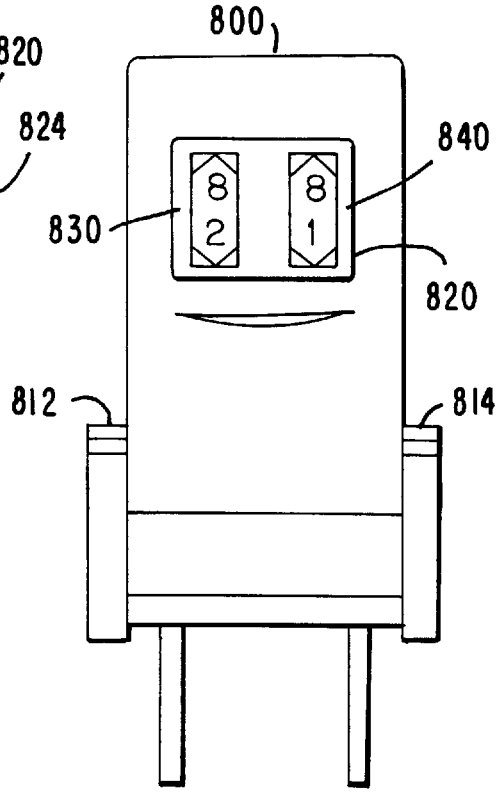
FIG. 8B is a rear elevational view of the non-exit-row aircraft cabin aisle seat of FIG. 8A.

Aids in accordance with this invention can also be formed by stitching or embroidering upholstery such as that on the backs or the sitting surface of seats, the stowed-visible surfaces of tray tables, etc., examples of which are aids 830, 840 of FIG. 8B and 850 of FIG. 8C.

The kinds of emergencies intended to be served by this invention include fire, and aids 100, 200, 300, 700, etc. are therefore preferably code-compliant with respect to flammability, thermal stability, heat release, toxicity of combustion products, etc. Because the aids of this invention are intended to serve tactilely as well as visually and aids that are too hot to touch cannot serve tactilely, the list of fire-related properties of interest with respect to the aids of this invention also includes thermal capacity and thermal conductivity, and cast metal aids are unsuitable for the reason mentioned despite their suitability for reasons of appearance, durability, and compliance with conventional code requirements.

Figure 5:
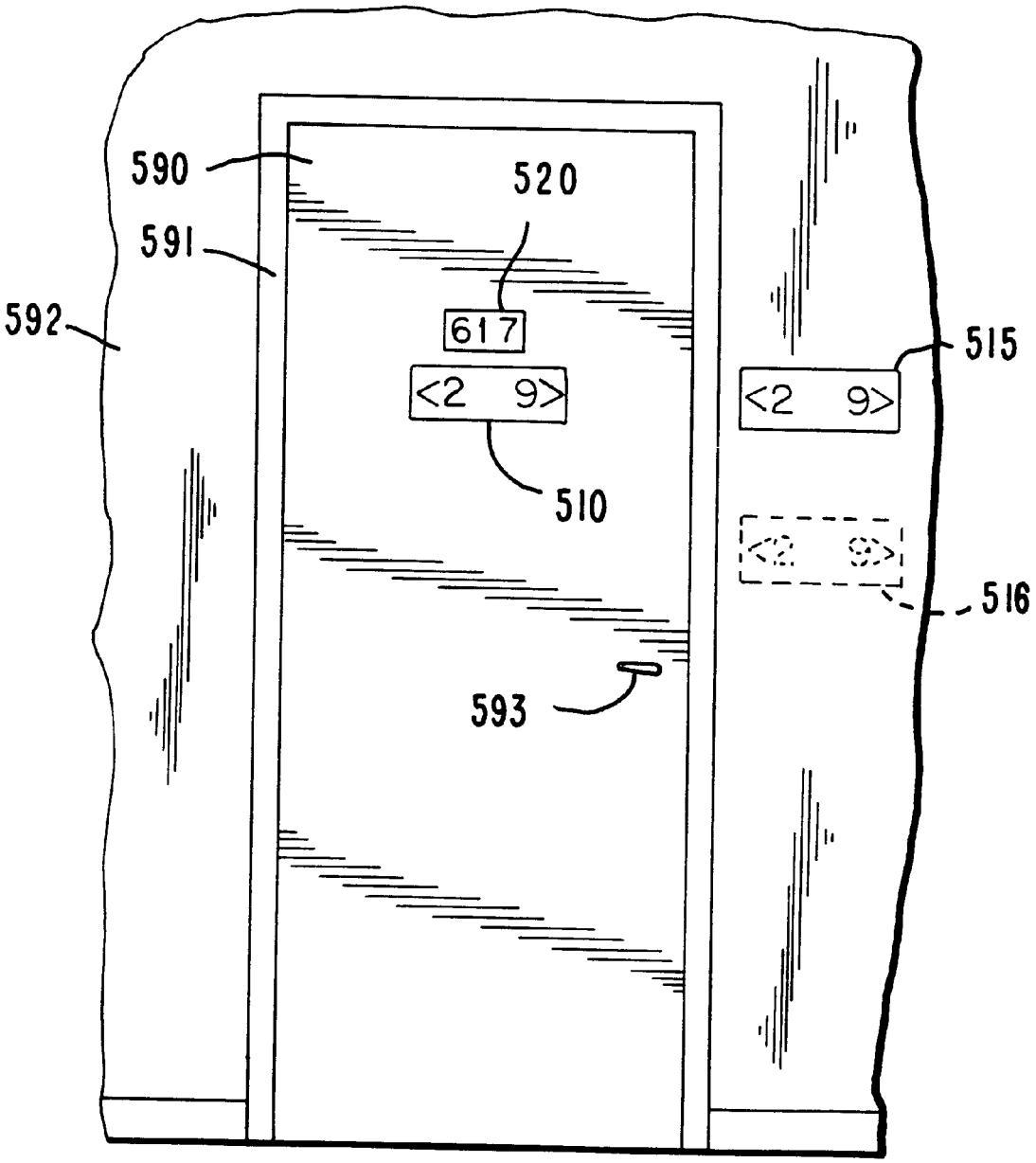
FIG. 5 is an elevational view of a door having an exit-finding aid in accordance with the present invention.

The embodiment of FIG. 5 is a door 590, the door frame 591, and a portion of the corridor wall or bulkhead 592 adjacent thereto, door 590 providing access from a corridor to one of a plurality of fixed defined occupiable spaces such as guest rooms in a structure such as a hotel or motel; student rooms in a dormitory; offices in an office building; cabins on a passenger vessel, etc. Door 590 is shown having a latch handle 593 on its latch side, and an exit-finding aid like that of FIG. 1, but here labeled 510, affixed to door 590, say with nails, screws or preferably, to avoid the kind of tactile confusion that can result from unplugged screw or nail holes or protruding screw or nail heads, a permanent adhesive, or, per FIG. 4D, an integral part of that door.

Aids like those of FIG. 1 are preferably affixed to or a part of both the space side and the corridor side of door 590, and are preferably centered horizontally at the presently ADA §4.30.6-required height of 60 in. (1525 mm.). Aids so positioned are not, however, on the present ADA §4.30.6-required latch side of wall or bulkhead 592 because aids positioned as preferred are easier to find tactilely than are ADA-compliant aids 515 that, if they were to the right of the door in the corridor, would be to the left of the door in the room; because aids positioned as preferred can positively identify doors to be included in the count of doors to an exit; and because aids positioned as preferred eliminate uncertainty with respect to whether doors immediately adjacent to aids on walls or bulkheads should be included in that count. Where strict compliance with ADA is required, the aids can, of course, be positioned as is aid 515 in the drawing, or, where appropriate, where both 510 and 515 are shown.

FIG. 5 also includes a second wall-based aid 516 shown dotted to suggest that it is intended to be the touch portion of a two-part aid in accordance with a proposed revision of ADA. Aid 516 is also shown positioned below aid 515 as allowed by that revision to make it readily accessible to a person in a wheelchair.

FIG. 5 further includes an indicia, room identifier 520, typical of what might be found on the corridor side of a door in a hotel or a motel.

Figure 6:
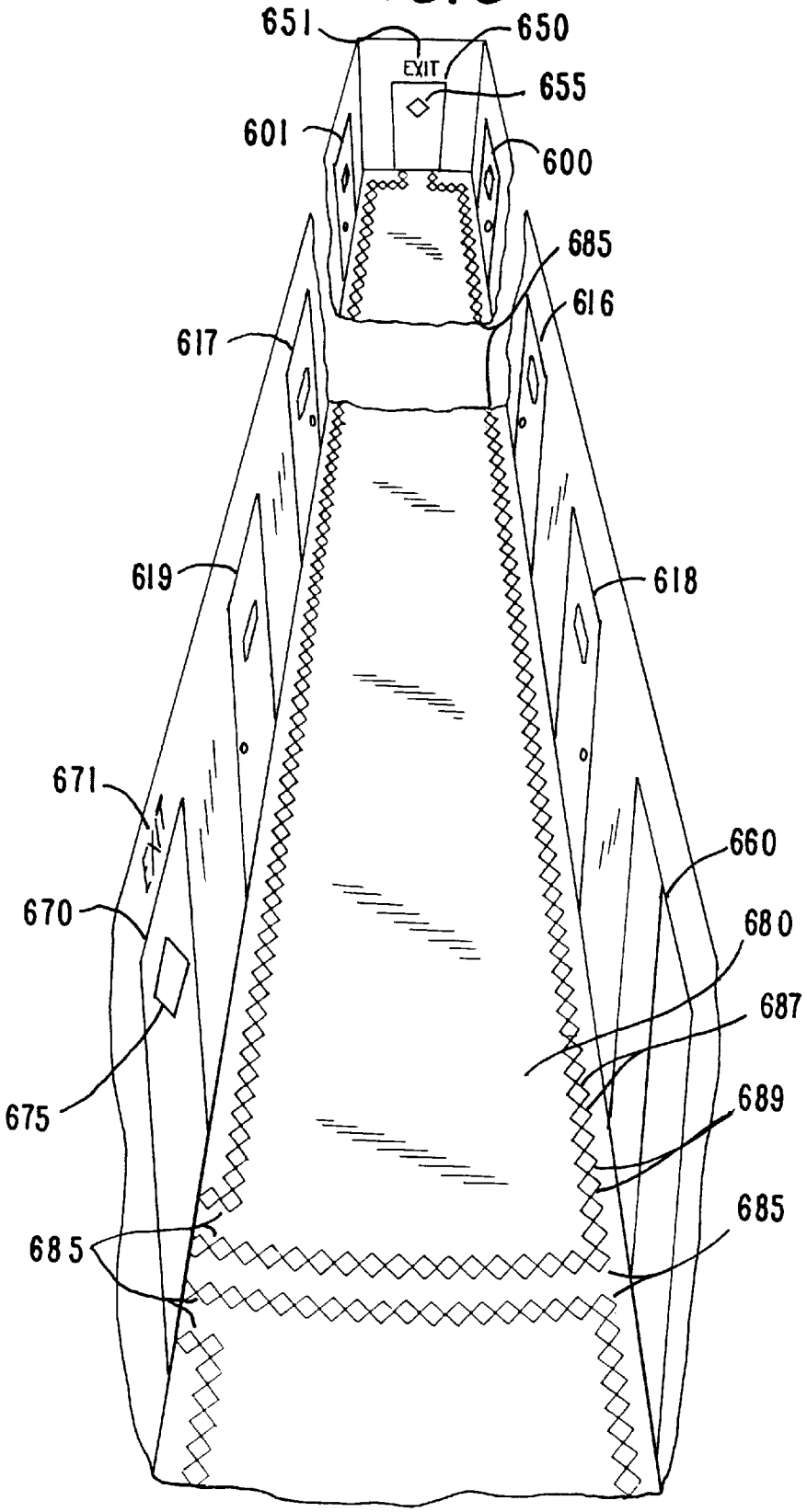
FIG. 6 is a fragmented perspective view of a hotel corridor having both door-based and floor-based exit-finding aids in accordance with the present invention.

The embodiment of FIG. 6 is a multideck or multistory structure of the kind mentioned, and the drawing shows some of the forty fixed defined occupiable spaces accessed by corridor 680. The spaces on the left are odd numbered and those on the right are even numbered, as shown. These spaces are served by two end-of-corridor exits, one of which, the one between spaces 600 and 601 is accessed by door 650 and is shown, as is the mid-corridor exit adjacent to space 619 and accessed by door 670, and by elevator 660 adjacent to space 618. Each exit in the structure is preferably identified by both a conventional exit sign and a FIG. 3-type exit-finding aid as are the exits shown; the exit accessed via door 650 by sign 651 and aid 655, the exit accessed via door 670 by sign 671 and aid 675.

Corridor 680 also serves as part of the escape path from the spaces, and that path is tactiovisually identified by floor-based marking 685. Tactiovisual floor-based escape path marking is known from the Honigsbaum Patent mentioned under related art, and escape path marking 685 is introduced in the same way here, i.e., by sculptured or selectively tufted carpeting, by tactiovisual strips on or in the flooring or floor covering material, etc., and serves an analogous purpose here.

While any recognizable pattern can be used for the purpose, the array of oppositely-facing directional symbols 687, 689 shown is preferred because it mimics both the directional symbols on the room-door-based aids and the overall configuration of the exit-door-based aids, and is therefore suggestive of its purpose, i.e., to lead one to an exit. It is additionally preferred because it can be made unidirectional and thus appropriate for "dead ends" by simply omitting the directional symbols pointing in the "wrong" direction.

Floor-based marking 685 is not only preferably tactiovisual; it is also preferably both wall or bulkhead proximal and continuous from exit to exit as shown, and is therefore readily found and followed to an exit under all conditions of vision and visibility, but, because marking 685 does not indicate distance to the exits in each of the directions indicated as do the door-based aids of this invention, not necessarily the closest one. Thus the floor-based and door-based aids in accordance with this invention not only complement one another tactiovisually; they also complement the vision-dependent aids, which are, of course, the conventional exit signs.

The spaces can be part of any of the structures mentioned with reference to FIG. 6, and the exit-finding process in accordance with this invention is described using as example a hotel in which the spaces are guest rooms on what, according to the numbering system shown in the drawing, is the sixth floor of the hotel, and the hotel is assumed to have both first-floor exit discharges and a seventh floor bridge or walkway to another building, Exit access doors 650, 670, and the one at the other end of the corridor (not shown in the drawing) are, in this hotel example, access doors to stairways going five flights down to the first-floor exit discharges and one flight up to the bridge or walkway floor. Exit access doors 650, 670, and the one at the other end of the corridor also isolate that corridor from smoke in the stairwells, and vice versa.

The exit-finding process begins when a guest in a room, say room 617, the second room to the left of exit access door 670, becomes aware of an emergency such as a fire in the hotel and determines or confirms from the touch-and-sight-recognizable FIG. 1 aid on the room side of his door that the nearest exits are two doors to the right and nine doors to the left of his room. Barring instructions from a responsible authority such as a fire marshal, from the house television channel, etc. to remain in his room or to use a particular exit, the guest next assays the condition in the corridor by first touch-sensing the temperature of the door and, if appropriate, proceeds to the nearest exit, which he knows from the aid on the room side of his room door or otherwise, is two doors to the right of his room, proceeds along the escape path, i.e., corridor 680, to that nearest exit, the one accessed by exit access door 670. He confirms arrival at exit access door 670 by his count of doors, from escape path marking 685, from conventional exit sign 671, by finding the touch-and-sight-recognizable and differently configured FIG. 3-type aid 675 on stairway access door 670, etc., and learns from that FIG. 3-type aid that the nearest exit from the hotel is one flight up (if he does not know so already), and assuming the stairway accessed by door 670 is usable, proceeds along the shorter escape path, i.e., one flight up and the walkway to the other building rather than the five flights down to the exit discharges.

FIG. 3-type aid 675 also tactiovisually displays the direction and the number of doors to alternate exits, i.e., the eleven doors in either direction to the exits at either end of the corridor, information that can be essential to survival if the exit accessed via door 670 is unusable. Assuming the exit accessed via door 670 is unusable and that visibility is compromised by smoke, a prudent guest would crawl along the corridor to an exit, maintain orientation by following the tactiovisual floor-based marking 685, reach up to tactilely confirm distance and direction to an exit from door-based FIG. 1-type door based aids, and would thus find and use a viable exit.

Exit-finding from the even-numbered rooms, those on the right side of corridor 680 is somewhat different from exit-finding from rooms on the left because there is an elevator 660 in lieu of a mid-corridor exit on the right, and elevator use is inappropriate under the conditions described. Thus a FIG. 1 -type aid on the room side of the door to room 616, the room opposite the previously mentioned room 617, would not lead its occupant to the exit on the opposite side of the corridor by indicating an exit two doors to the left if that exit could not be seen from across the corridor for reasons of compromised vision or smoke-compromised visibility.

Exit-finding from rooms on the right hand side of corridor 680 is addressed by exitfinding aids in accordance with FIG. 7, the touch-and-sight-recognizable marking 685 on the corridor floor, or both.

The aid 700 that is the embodiment of FIG. 7 has a left symbol-character pair 720 that tactiovisually indicates distance and direction to the nearest exit to the left, a right symbol-character pair 740 that similarly indicates distance and direction, but to the right, and a touch-and-sight-recognizable horizontal bar or strip 753. Strip 753 is intended to represent the corridor, and left pair 720 is above that strip to indicate that the nearest exit to the left is on the far side of a corridor and is best found by counting doors on that previously mentioned far side of the corridor, while right pair 740 is below strip 753 to indicate that the nearest exit to the right can be found by counting doors to the right on the near side of the corridor. Aid 700 also has a space 750 separating the left symbol-number pair from the right, that space corresponding to space 150 of the aid of FIG. 1, and while space 750 can be used for the purpose mentioned for space 150, the same caveat applies.

Figure 8A:
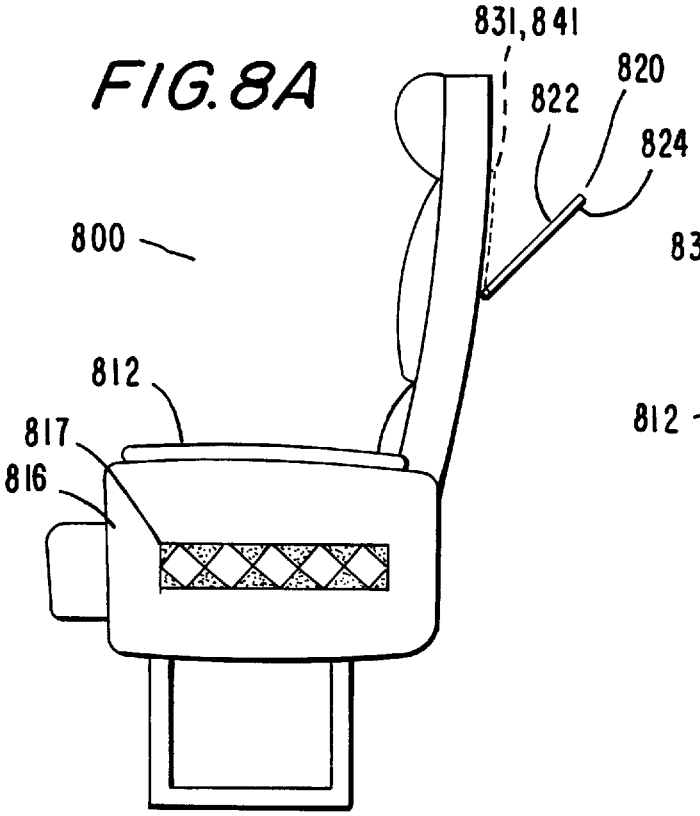
FIG. 8A is a side elevational view of a non-exit-row aircraft cabin aisle seat having exit-finding aids in accordance with the present invention.

The embodiment of FIGS. 8A, B and C is also a fixed defined occupiable space, one of a plurality of fixed seats arranged in rows in a structure, and that are accessed by a main aisle that is also part of an escape path from that structure. The structure can be an aircraft cabin, an auditorium, a house of worship, a sports arena, a stadium, a theater, etc., but the aircraft cabin is the example of choice for purposes of illustration and explanation here because aircraft cabin occupant density is significantly higher than is the occupant density in the other structures mentioned; fuselage bum-through time is short; and aircraft cabin side-section seat rows are either exit rows or dead ends. While the aircraft cabin example is appropriate for the reasons stated, this invention is also applicable to structures having bleacher-type seats, and the appropriate place for the aids of this invention on such seats is the sitting surface, e.g., where aid 850 of FIG. 8C is shown.

The embodiment of the seat shown in side elevation in FIG. 8A, in rear elevation in FIG. 8B, and in plan in FIG. 8C is a non exit-row aisle seat in an aircraft passenger cabin, and is generally designated 800 in the drawings. Seat 800 is shown as having a tray table 820, and tray table 820 is shown ready to receive a tray in FIG. 8C, in the takeoff and landing position in FIG. 8B, i.e., stowed as required by 14 CFR 121.577, and somewhere between stowed and ready to receive a tray in FIG. 8A. The tray table 820 on seat 800, and the corresponding tray tables on the other seats are the primary passenger cabin display points for the aids of this invention, and the FIG. 2-type aids for non-exit-row seats are preferably displayed (with or without seat identifier 255) on both the faces of the tray tables as shown, so that a cabin occupant can know the distance and direction to the nearest exit in each direction in a situation requiring emergency evacuation; can know so before leaving his seat; can know so without having to count seat rows and remember the count; and can know so by touch as well as by sight regardless of whether the tray table is ready for use or is stowed.

Tray table 820 is shown having the preferred aid arrangement of two FIG. 2-type aids, 835, 845, on its tray-holding side 822, and two more, 830, 840, on the stowed-visible side 824. Aids 830, 835 on the port (left) side of the tray table indicate the distance in seat rows and the corresponding direction to the nearest exits forward and aft on the port side of the cabin, and aids 840, 845 do the same for exits on the starboard (right) side. This port-starboard aid arrangement is preferred because some one-aisle aircraft, e.g., the Boeing 727-200, have asymmetrical exit arrangements and more seat rows on one side of their main aisle than they do on the other, and because two-main-aisle aircraft typically have side section seat-row-to-exit counts that are different from those for the center. Where seats do not have tray tables attached, e.g., the aft-most seats, aids 831, 841 (shown dotted) are affixed to or a part of the seat backs in lieu of tray-table based aids 830, 835, 840, 845.

Aids 830, 835, 840, 845 and the corresponding aids on the other tray tables in the cabin can have the rectangular base portions shown in FIG. 2, the flattened hexagonal base portions suggested by the dotted lines 125, 145 in FIG. 1, or the no-base versions of FIGS. 4A, 4D, etc., the absence or presence of a base portion being dictated in part by the tray table surface on which the aids are displayed. Thus no-base versions are preferred for tray holding surfaces 822 where base edges can collect and hold food and bacterial contamination because eliminating base portions there eliminates such contamination as well, No such restriction applies to tray table surfaces 824 that are visible when these tables are stowed, but where stowed-visible surfaces are fabric covered it might be appropriate to stitch or embroider just the symbols and the numbers on that fabric. If, however, the aids were pre-embroidered on labels, the aids would have bases because the base portions of the labels would be the base portions of the aids as well.

Seat 800 is also shown as having a dedicated armrest 812 (the other armrest, 814, may be shared), and dedicated armrests that have seat identifiers preferably have FIG. 2-type aids 813 that include indicia such as 255 of FIG. 2 as well.

Seat 800 is also, for purposes of exposition, assumed to be an aisle seat having an aisle-side side panel or seat skirt 816 where an optional type FIG. 1 exit-finding aid could be displayed. The numberless bi-directional marking 817 shown is preferred, however, because passengers who neither count seat rows nor consult tray table or seat based aids to determine distance and direction to exits, and who respond to emergency evacuations by ignoring the aids on tray tables, entering aisles oblivious to the distance and direction to the nearest or alternate exits, and stopping to determine distance and direction from aisle-side seat skirt or side panel aids, can slow evacuation.

Figure 9:
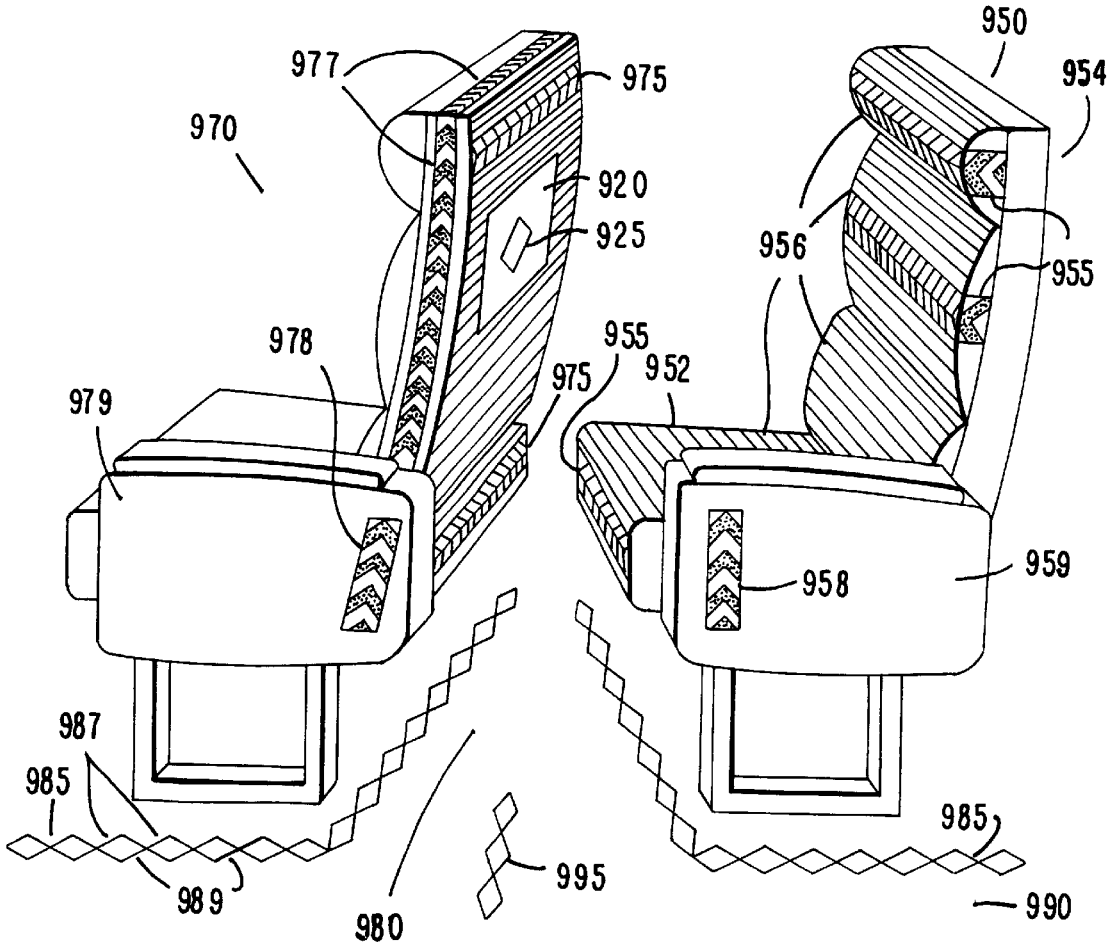
FIG. 9 is a perspective view of part of the portion of the escape path from the main aisle to the exit in an aircraft cabin having exit-finding aids in accordance with the present invention.

The embodiment of FIG. 9 is the portion of an aircraft passenger cabin that includes an exit row aisle seat, the seat immediately forward of that exit row aisle seat, a portion of the cabin floor between those seats and a portion of the main aisle adjacent to them. Thus the drawing shows portions of: exit row aisle seat 950, the seat immediately forward thereof, 970, the floor between these seats, 980, and the main aisle floor 990 adjacent to those seats.

Exit row seat 950 is in accordance with this invention, and is immediately recognizable as an exit row seat by virtue of preferably distinctive touch-and-sight-recognizable upholstery on seat cushion 952 and the forward-facing portions 956 of seat back 954, at least one repetitive array of embroidered, sewn, stitched or woven unidirectional touch-and-sight-recognizable symbols 955 on seat cushion 952 and on the forward-facing portion of seat 954, and array 958 on aisle-side seat skirt or side panel 959, all shown.

Seat 970, the seat immediately forward of exit row aisle seat 950, is immediately recognizable as such by the distinctive touch-and-sight-recognizable upholstery on the aft-facing portions of that seat, preferably the same such upholstery as is on seat 950, the arrays 975 that, excepting their location, are preferably the same as those on seat 950, array 977 that, depending on seat construction, is molded, embroidered, etc. into the aisle-facing side and the top of the back of seat 970 aisle-side seat skirt or side panel 979 array 978 that is preferably aligned with array 977 as shown; and the tray table 920 FIG. 3-type aid 925 that indicates distance and direction to the nearest and to alternate exits.

The drawing also shows floor-based escape path marking 985 of the kind having the oppositely facing touch-and-sight-recognizable directional symbols 987, 989 that are familiar from FIG. 6, but that here mark the portions of the escape path along main aisle 990, and from that main aisle to exit row escape path portion 980, and along escape path portion 980, as shown. This marking also identifies the escape paths to exits in each aisle direction. Similar marking 995 can also be used to identify the path from an exit or exits on one side of an aircraft to an exit or exits on the other.

Thus the escape path portion and direction both along the main aisle and from the main aisle to an exit is immediately identifiable by touch as well as by sight, and therefore under all conditions of vision and visibility, by virtue of the marking 985 on the floor of that path portion, the FIG. 3-type aid 925 on tray table 920, the distinctive upholstery and unidirectional arrays 955, 958, 975, 977, 978 on seats 950, 970 and preferably, excepting the arrays that face aisle 990, the other seats that flank path portion 980 as well, and is so identifiable not only by those walking or crawling along main aisle 990, but also those climbing over seats and those climbing over obstacles in the main aisle as well. Some aircraft also have passenger seats aft of the aft-most exit, and the floor marking of aisle portions adjacent to those seats would, of course, be the unidirectional marking mentioned earlier herein).

The process of exit-finding in accordance with this invention in aircraft parallels that for buildings and ships. Thus the passenger for whom the FIG. 2-type aids on tray table 820 of FIGS. 8A, B & C are intended, i.e., the occupant of seat 24D, the seat immediately aft of the seat of FIGS. 8 would, as response to an emergency the appropriate response to which is evacuation, consult either those aids or the one on his armrest to determine or to confirm his recollection of the number of seat rows to the nearest exit (or pair of exits) in each direction, and barring instructions from a responsible authority such as a pilot or a flight attendant to remain seated, to use or to avoid a particular exit, etc., would know from aid 840 that his nearest exit is one starboard seat row aft, leave his seat, and proceed to that exit, an exit which, because it is aft of his seat and his seat faces forward, he might not, in lieu of aid 840, have known was there.

If, however, the emergency is one that renders the aft exits of the aircraft (assumed to be a Boeing 727-200) unusable, he would proceed to the nearest alternate exit by walking the main aisle the eight seat rows forward to that exit, by seat-climbing, or by some combination of the two. (He would be ill-advised to crawl where other passengers could trample him in their haste to evacuate.) The aircraft version of the present invention provides a plurality of noncontradictory cues both to the escape path and to an exit row that are effective under all conditions of vision and visibility, the first of which are the tray table and armrest aids, the non-exit-row aisle seat side panel or seat skirt marking 817 of FIG. 8A, and the floor-based marking 985 of FIG. 9 parallel thereto.

Because virtually every seat row in this aircraft that is not an exit row is a dead-end, proper identification of the path portion from the main aisle to an exit is of prime importance, and touch-and-sight-recognizable cues to this path portion and the direction to the exit are provided at every touch-and-sight-addressable level from the cabin floor to the top of the seats flanking this path portion, as is clear from FIG. 9. Thus the consequences of a seat row miscount are minimal.

The terms "tactiovisual" and "touch-and-sight-recognizable" have been used interchangeably in describing this invention to emphasize the point that the elements of each aid, and, where appropriate, the aids themselves, i.e., the directional symbols, the number characters, the symbol-character pairs, the bases, the floor-based and seat-based arrays and their directional symbols are preferably recognizable by touch if seen and by sight if touched.

The term "exit discharge" has been used herein to refer to an exit from a structure.

The terms "port," "starboard," "forward" and "aft" are aviation and nautical terms that have been used both here and in the claims to indicate direction with respect to a structure where their more familiar counterparts, "left," "right," "ahead" and "behind," might be interpreted as indicating direction with respect to an occupant. They are not intended to limit descriptions or claims to the kinds of structures, e.g., ships and aircraft, to which these terms conventionally apply.

The terms "wall" and "floor," which typically refer to buildings are also intended to refer to their respective ship counterparts "bulkhead" and "deck" both here and in the claims, and, where obvious and appropriate herein, their aircraft counterparts as well.

The terms "accessible" and "handicapped accessible" both here and in the claims refer aids that are so in the ADA sense.

The new, novel and useful features of this invention have been described in detail with reference to embodiments of structures such as hotels and aircraft, and persons having ordinary skill in the art will recognize their applicability to other structures as well. Thus the embodiments shown in the drawings and described herein are intended to be illustrative rather than limiting, the actual scope of the invention being defined by the appended claims.

I claim:

1. A guidance system for providing directional information to a user, comprising:

a plurality of multi-directional-capable tactiovisual signs being integral with or affixed to substantially fixed architectural features, each one of the plural multi-directional-capable tactiovisual signs having a plurality of separate spaces, wherein each one of the plural separate spaces is approximately equal in size and corresponds to a direction away from the location of the multi-directional-capable tactiovisual sign, wherein said each one of the plural separate spaces is capable of containing a tactiovisual numeral-symbol pair, wherein said each one of the plural multi-directional-capable signs has at least one tactiovisual numeral-symbol pair, wherein every one of the plural separate spaces whose corresponding direction is a path direction to an exit has a tactiovisual numeral-symbol pair, wherein the absence of a tactiovisual numeral-symbol pair from one or more of said plural separate spaces indicates that the direction corresponding to each of said one or more plural separate spaces is not a path direction to an exit, wherein at least one of the plural separate spaces of at least one of the multi-directional-capable signs does not contain a tactiovisual numeral-symbol pair, and wherein each tactiovisual numeral-symbol pair comprises:

a numeral recognizable by touch and sight, the numeral indicating a number of substantially fixed countable architectural features along the path from the location of the multi-directional-capable sign to the exit; and a symbol recognizable by touch and sight, the symbol indicating the path direction to the exit.

2. The system as recited in claim 1, wherein said each one of the plural multi-directional-capable tactiovisual signs comprises one of a decal, a tag, a raised or relief section of the substantially fixed architectural features, furniture, furniture upholstery, or an attachable piece of wood, metal, or plastic.

3. The system as recited in claim 1, wherein said each one of the plural multi-directional-capable tactiovisual signs has a shape substantially comprising one of a circle, a square, a rectangle, a polygon, an oval, and an ellipse.

4. The system as recited in claim 1, wherein the substantially fixed architectural features to which one or more of the plural multi-directional-capable tactiovisual signs are integral or affixed comprise at least one of walls, doors, door frames, bulkheads, aircraft passenger seats, auditorium seats, theater seats, and pews in a house of worship.

5. The system as recited in claim 1, wherein the substantially fixed architectural features to which one or more of the plural multi-directional-capable tactiovisual signs are integral or affixed comprise aircraft passenger seats and wherein said one or more of the plural multi-directional-capable tactiovisual signs are integral with or affixed to at least one of tray tables, armrests, and upholstery of the aircraft passenger seats.

6. The system as recited in claim 1, wherein the substantially fixed countable architectural features of which the numeral indicates the number comprise at least one of seats, seat rows, doors, doorways, stair flights, floors, and decks of a ship.

7. The system as recited in claim 1, wherein the substantially fixed countable architectural features of which the numeral indicates the number are substantially identical to each other.

8. The system as recited in claim 1, wherein the symbol recognizable by touch and sight comprises at least one of a vee, a chevron, an arrow, and an arrowhead.

9. The system as recited in claim 1, wherein at least one of the plurality of multi-directional-capable tactiovisual signs comprises:

a bi-directional-capable sign.

10. The system as recited in claim 9, wherein said bi-directional-capable sign has a first space containing a first numeral-symbol pair and a second space capable of containing a second numeral-symbol pair, wherein the first space is located distally from the second space.

11. The system as recited in claim 1, wherein at least one of the plurality of multi-directional-capable tactiovisual signs comprises:

a quad-directional-capable sign.

12. The system as recited in claim 11, wherein said quad-directional-capable sign has a first space containing a first numeral-symbol pair, and has second, third, and fourth spaces capable of containing second, third and fourth numeral-symbol pairs, respectively, and wherein the first space is located distally from the second space and the third space is located distally from the fourth space.

13. The system as recited in claim 12, wherein the path direction indicated by the first numeral-symbol pair is one of fore and aft, the direction away from the quad-directional sign corresponding to the second space is the other of fore and aft, the direction away from the quad-directional sign corresponding to the third space is port, and the direction away from the quad-directional sign corresponding to the fourth space is starboard.

14. The system as recited in claim 12, wherein the directions away from the quad-directional sign corresponding to the first and second spaces are on a level where the quad-directional-capable sign is located, and the directions away from the quad-directional sign corresponding to the third and fourth spaces are on different levels than the level where the quad-directional sign is located.

15. The system as recited in claim 1, further comprising:

a plurality of floor means for indicating at least one path to an exit, wherein the plural floor means uses at least one of tactile sensation and visual sensation to indicate said at least one path.

16. The system as recited in claim 15, wherein the plural floor means are at least one of integral with and affixed to at least one of a floor, flooring, and a floor covering.

17. The system as recited in claim 15, wherein the plural floor means are symbols, and at least a portion of each of the floor symbols has substantially the same shape as at least a portion of said symbols of said multi-directional-capable signs.

18. The system as recited in claim 17, wherein the same shape is substantially arrowhead-like.

19. The system as recited in claim 17, wherein each of the floor symbols indicates the same direction to an exit along floor portions where there is only one direction to an exit, and wherein adjacent ones of the floor symbols alternate in indicating one or the other direction to an exit where there are exits in opposite directions.

20. The system as recited in claim 15, wherein the plural floor means for indicating at least one path to an exit are plural tactiovisual floor means which use both tactile and visual sensation to indicate said at least one path.

21. The system as recited in claim 20, wherein the plural tactiovisual floor means comprises at least one of sculptured carpeting, tactiovisual strips, sculptured flooring, a sculptured floor, and tactiovisual directional symbols affixed to one of the floor, flooring, or floor covering.

22. The system as recited in claim 21, wherein said sculptured carpeting comprises at least one of selectively-tufted, woven, inlaid, and selectively-cut-pile carpeting.

23. The system as recited in claim 21, wherein the plural tactiovisual strips are at least one of on, embedded in, and positioned between portions of, the floor, flooring, or floor covering.

24. The system as recited in claim 20, wherein the plural tactiovisual floor means form a substantially continuous path to an exit.

25. The system as recited in claim 20, wherein the plural tactiovisual floor means form a substantially continuous path comprising a repetitive pattern of directional symbols indicating a direction to an exit.

26. A guidance system for providing directional information to a user, comprising:

a plurality of bi-directional-capable tactiovisual signs being integral with or affixed to substantially fixed architectural features along a corridor, each one of the plural bi-directional-capable signs comprising:

a right space capable of containing a tactiovisual numeral-symbol pair and corresponding to a direction to the right of the bi-directional-capable sign;

a left space capable of containing a tactioovisual numeral-symbol pair and corresponding to a direction to the left of the bi-directional-capable sign; and a substantially horizontal tactiovisual strip dividing each of the left space and the right space into an upper half and a lower half wherein the upper half is substantially the same size as the lower half;

wherein the right space is approximately the same size as the left space;

wherein said each one of the plural bi-directional-capable signs has at least one tactiovisual numeral-symbol pair;

wherein every space whose corresponding direction is a path direction to an exit has a tactiovisual numeral-symbol pair;

wherein every space whose corresponding direction is not a path to an exit does not contain a tactiovisual numeral-symbol pair; and wherein each tactiovisual numeral-symbol pair comprises:

a numeral recognizable by touch and sight, the numeral indicating a number of substantially fixed countable architectural features along the path from the location of the bi-directional-capable tactiovisual sign to the exit; and a symbol recognizable by touch and sight, the symbol indicating the path direction to the exit; and wherein tactiovisual numeral-symbol pairs are located in the upper half of the right spaces, the upper half of the left spaces or the upper half of both spaces of said bi-directional-capable signs integral with or affixed to a corridor side of said fixed architectural features to indicate said path direction and said number of substantially fixed countable architectural features along the same side of the corridor as the bi-directional-capable sign;

tactiovisual numeral-symbol pairs are located in the lower half of the right spaces, the lower half of the left spaces or the lower half of both spaces of said bi-directional-capable signs integral with or affixed to a corridor side of said fixed architectural features to indicate said path direction and said number of substantially fixed countable architectural features along the side of the corridor opposite the bi-directional-capable sign;

tactiovisual numeral-symbol pairs are located in the upper half of the right spaces, the upper half of the left spaces or the upper half of both spaces of said bi-directional-capable signs integral with or affixed to a room, office or cabin side of said fixed architectural features to indicate said path direction and said number of substantially fixed countable architectural features along the side of the corridor opposite the bi-directional-capable sign; and tactiovisual numeral-symbol pairs are located in the lower half of the right spaces, the lower half of the left spaces or the lower half of both spaces of said bi-directional-capable signs integral with or affixed to a room, office or cabin side of said fixed architectural features to indicate said path direction and said number of substantially fixed countable architectural features along the same side of the corridor as the bi-directional-capable sign.

27. The system as recited in claim 26, wherein said each one of the plural bi-directional-capable tactiovisual signs comprises one of a decal, a tag, a raised or relief section of the substantially fixed architectural features, furniture, furniture upholstery, or an attachable piece of wood, metal, or plastic.

28. The system as recited in claim 26, wherein said each one of the plural bi-directional-capable tactiovisual signs has a shape substantially comprising one of a circle, a square, a rectangle, a polygon, an oval, and an ellipse.

29. The system as recited in claim 26, wherein the substantially fixed architectural features to which the plural bi-directional-capable tactiovisual signs are integral or affixed comprise at least one of walls, doors, door frames, bulkheads, aircraft passenger seats, auditorium seats, theater seats, and pews in a house of worship.

30. The system as recited in claim 26, wherein the substantially fixed countable architectural features of which the numeral indicates the number comprise at least one of seats, seat rows, doors, and doorways.

31. The system as recited in claim 26, wherein the substantially fixed countable architectural features of which the numeral indicates the number are substantially identical to each other.

32. The system as recited in claim 26, wherein the symbol recognizable by touch and sight comprises at least one of a vee, a chevron, an arrow, and an arrowhead.

33. The system as recited in claim 26, further comprising a plurality of tactiovisual floor means, wherein the plural tactiovisual floor means are one of integral with and affixed to one of a floor, flooring, and a floor covering.

34. The system as recited in claim 26, further comprising:

a floor-based marking system having a plurality of tactiovisual floor means, wherein the plural tactiovisual floor means are symbols and at least a portion of each of the floor symbols has substantially the same shape as at least a portion of the symbols of said bi-directional signs.

35. The system as recited in claim 34, wherein the plural tactiovisual floor means comprises at least one of sculptured carpeting, tactiovisual strips, sculptured flooring, a sculptured floor, and tactiovisual directional symbols affixed to one of a floor, flooring, or floor covering.

36. The system as recited in claim 35, wherein said sculptured carpeting comprises at least one of selectively tufted, woven, inlaid, and selectively-cut-pile carpeting.

37. The system as recited in claim 35, wherein the tactiovisual strips are at least one of on, embedded in, and positioned between portions of the floor, flooring, or floor covering.

38. The system as recited in claim 34, wherein the plural tactiovisual floor means form a substantially continuous pattern indicating a direction to an exit.

39. The system as recited in claim 34, wherein the plural tactiovisual floor means form a substantially continuous repetitive pattern of directional symbols indicating a direction to an exit.

40. The system as recited in claim 34, wherein the same shape is substantially arrowhead-like.

41. The system as recited in claim 34, wherein each of the floor symbols indicates the same direction to an exit along floor portions where there is only one direction to an exit, and wherein adjacent ones of the floor symbols alternate in indicating one or the other direction to an exit where there are exits in opposite directions.

42. A guidance system for providing directional information to a user in a multi-level structure, comprising:

a plurality of quad-directional-capable tactiovisual signs being integral with or affixed to substantially fixed architectural features in the multi-level structure, wherein each of the substantially fixed architectural features is a feature located at or near means for reaching another level of the multi-level structure, each one of the plural quad-directional-capable tactiovisual signs comprising:

a top space capable of containing a tactiovisual numeral-symbol pair and corresponding to an upward direction from the quad-directional-capable tactiovisual sign;

a left space capable of containing a tactiovisual numeral-symbol pair and corresponding to a direction to the left of the quad-directional-capable tactiovisual sign, a bottom space capable of containing a tactiovisual numeral-symbol pair and corresponding to a downward direction from the quad-directional-capable tactiovisual sign, and a right space capable of containing a tactiovisual numeral-symbol pair and corresponding to a direction to the right of the quad-directional-capable tactiovisual sign, wherein each of the spaces is approximately equal in size, wherein said each one of the plural quad-directional-capable signs has at least one tactiovisual numeral-symbol pair; and wherein every space whose corresponding direction is a path direction to an exit has a tactiovisual numeral-symbol pair, wherein every one of the plural separate spaces that does not contain a tactiovisual numeral-symbol pair indicates that its corresponding direction is not a path direction to an exit, and wherein each tactiovisual numeral-symbol pair comprises:

a numeral recognizable by touch and sight, the numeral indicating a number of substantially fixed countable architectural features along the path from the location of the quad-directional-capable tactiovisual sign to the exit; and a symbol recognizable by touch and sight, the symbol indicating the path direction to the exit.

43. The system as recited in claim 42, wherein each one of the plural quad-directional-capable tactiovisual signs comprises one of a decal, a tag, a raised or relief section of the substantially fixed architectural features, furniture, furniture upholstery, or an attachable piece of wood, metal, or plastic.

44. The system as recited in claim 42, wherein each one of the plural quad-directional-capable tactiovisual signs has a shape substantially comprising one of a circle, a square, a rectangle, a polygon, an oval, and an ellipse.

45. The system as recited in claim 42, wherein the substantially fixed architectural feature to which each one of the plural quad-directional-capable tactiovisual signs is integral or affixed comprises at least one of a wall, a door, a door frame, and a bulkhead.

46. The system as recited in claim 42, wherein the means for reaching another level of the multi-level structure comprises a stairway and wherein the feature located at or near the means for reaching another level of the multi-level structure comprises one of a door, a doorway to the stairway and a portion of a wall proximal to said door or doorway.

47. The system as recited in claim 42, wherein the substantially fixed countable architectural features of which the numeral indicates the number comprise at least one of seats, seat rows, doors, doorways, stair flights, floors, and decks of a ship.

48. The system as recited in claim 42, wherein the substantially fixed countable architectural features of which the numeral indicates the number are substantially identical to each other.

49. The system as recited in claim 42, wherein the symbol recognizable by touch and sight comprises at least one of a vee, a chevron, an arrow, and an arrowhead.

50. The system as recited in claim 42, further comprising:

a floor-based marking system having a plurality of tactiovisual floor means, wherein the plural tactiovisual floor means are one of integral with and affixed to one of a floor, flooring, and a floor covering.

51. The system as recited in claim 50, wherein the plural tactiovisual floor means are symbols, and at least a portion of each of the floor symbols have substantially the same shape as at least a portion of each of the symbols of said plural quad-directional-capable tactiovisual signs.

52. The system as recited in claim 51, wherein the same shape is substantially arrowhead-like.

53. The system as recited in claim 51, wherein each of the floor symbols indicates the same direction to an exit along floor portions where there is only one direction to an exit, and wherein adjacent ones of the floor symbols alternate in indicating one or the other direction to an exit where there are exits in opposite directions.

54. The system as recited in claim 50, wherein the plural tactiovisual floor means comprises at least one of sculptured carpeting, tactiovisual strips, sculptured flooring, a sculptured floor, and tactiovisual directional symbols affixed to one of the floor, flooring, or floor covering.

55. The system as recited in claim 54, wherein the sculptured carpeting comprises at least one of selectively-tufted, woven, inlaid, and selectively-cut-pile carpeting.

56. The system as recited in claim 54, wherein the tactiovisual strips are at least one of on, embedded in, and positioned between portions of, the floor, flooring or floor covering.

57. The system as recited in claim 50, wherein the plural tactiovisual floor means form a substantially continuous pattern indicating a direction to an exit.

58. The system as recited in claim 50, wherein the plural tactiovisual floor means form a substantially continuous repetitive pattern of directional symbols indicating a direction to an exit.

* * * * *